United States Patent [19]

Shook et al.

[11] Patent Number: 4,873,738

[45] Date of Patent: Oct. 17, 1989

[54] APPARATUS FOR STRIPPING CONCRETE FORMS FROM BRIDGE STRUCTURES

[75] Inventors: Hal C. Shook, Kensington, Ga.; Carmon D. Holland, Laurel, Miss.

[73] Assignee: CFC Fabrication Corporation, Chattanooga, Tenn.

[21] Appl. No.: 250,949

[22] Filed: Sep. 29, 1988

[51] Int. Cl.[4] ..... E01D 21/00

[52] U.S. Cl. ..... 14/1; 14/73; 425/62; 425/65; 249/2

[58] Field of Search ..... 14/1, 6, 73, 2.4; 404/83; 264/31, 33; 425/62, 63, 65; 249/2, 23; 52/749

[56] References Cited

U.S. PATENT DOCUMENTS

| | | | |
|---|---|---|---|
| 3,827,840 | 8/1974 | Kistler | 425/62 |
| 4,123,031 | 10/1978 | Hyre | 14/1 X |
| 4,231,977 | 11/1980 | Schreck et al. | 425/63 X |
| 4,450,120 | 5/1984 | Maier | 264/31 |
| 4,478,773 | 10/1984 | Büchler et al. | 264/31 |
| 4,778,144 | 10/1988 | Gregory | 425/63 X |

*Primary Examiner*—Jerome W. Massie
*Assistant Examiner*—Matthew Smith
*Attorney, Agent, or Firm*—Alan Ruderman

[57] ABSTRACT

Apparatus for stripping concrete forms from the underside of a concrete roadbed of a bridge under construction has a carriage positioned on and driven longitudinally along the upper surface of the roadbed. The carriage carries spaced apart transversely extending support beams having rack gearing which meshes with pinions carried by housings telescopically received on the support beam and having rollers for rolling on tracks on the support beams. Each support beam has two housings which may move toward and away from each other. The housings carry downwardly depending framework extending beneath the roadbed and supporting a work platform support section. The two work platform support sections associated with each carrier beam may interlock to form a continuous work platform support at each longitudinal end of the apparatus, and may separate when the housings associated with each support beam are driven away from each other to provide a clearance about the pier caps of the bridge. The work platform supports have transversely extending rails on which a longitudinally extending stripping buggy is driven transversely, the stripping buggy carrying scissors jacks which may be raised to receive the concrete forms and thereafter lowered. The stripping buggy with the forms are driven to the ends of the work platform for removal and transfer to a subsequent section of the bridge.

14 Claims, 2 Drawing Sheets

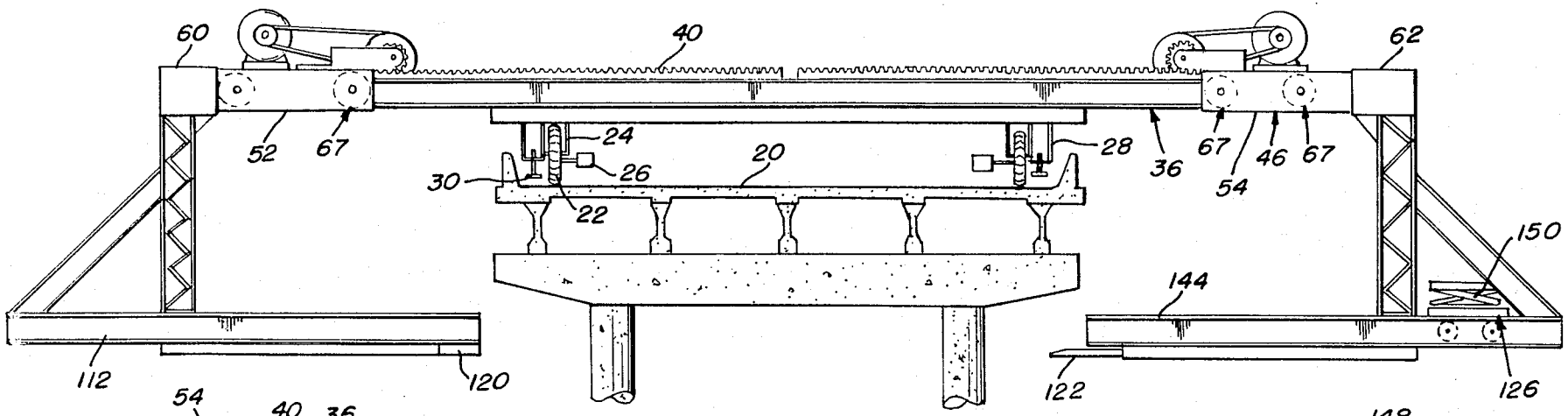
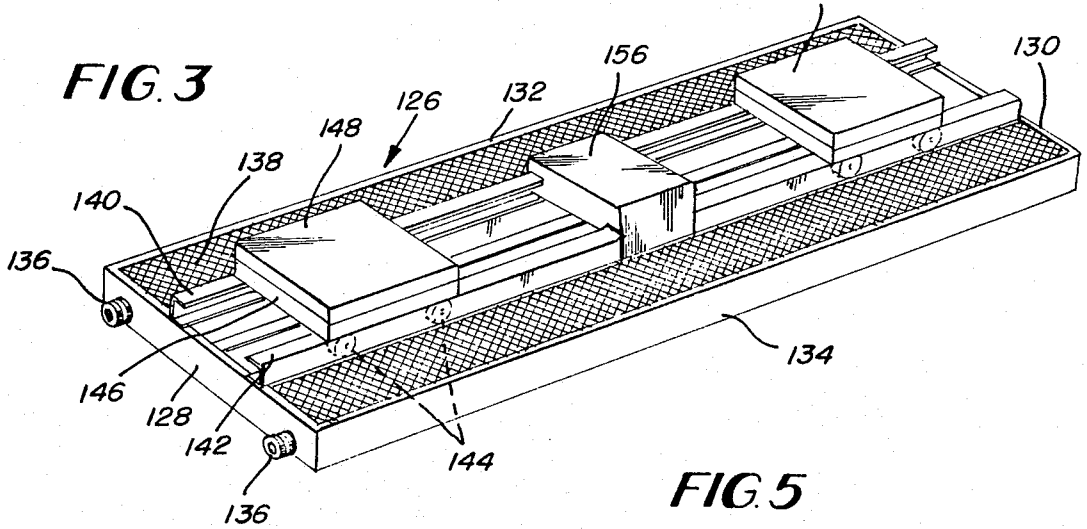
FIG. 5
FIG. 3
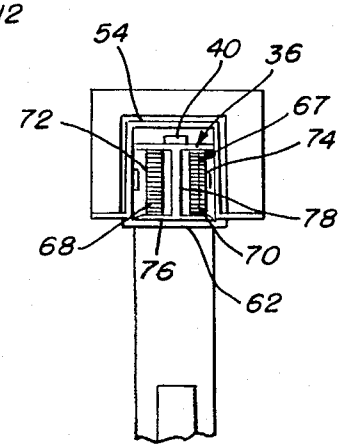
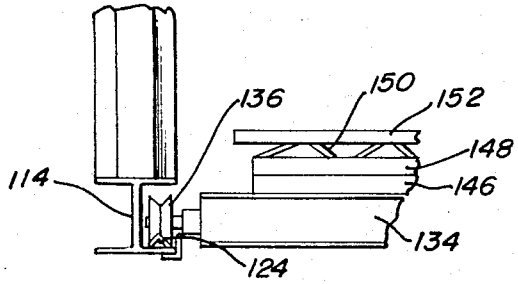
FIG. 4

APPARATUS FOR STRIPPING CONCRETE FORMS FROM BRIDGE STRUCTURES

BACKGROUND OF THE INVENTION

This invention relates to the stripping or removal of concrete forms from the roadbed of bridges during the construction of the bridge and more particularly to apparatus supported on and driven along the surface of poured concrete roadbed sections of a bridge, the apparatus including support members disposed beneath the roadbed for carrying apparatus for removing the forms and which support members may move transversely to clear the vertical piers which support the bridge.

In the construction of concrete roadbed bridges concrete pouring forms are disposed adjacent precast longitudinally extending beams carried by transversely extending pier caps or bents supported on piles or columns. For multiple span bridges, i.e., bridges having super-structures spanning a number of longitudinally spaced apart piers, the roadbed is poured in sections, each section generally comprising the portion of the bridge between adjacent pier caps. After the concrete has begun to cure, the concrete forms from a first section are removed or stripped and utilized for the pouring of a subsequent section.

The conventional stripping of the concrete pouring forms can be a time consuming procedure increasing the bridge construction time and cost. For multiple span bridges the forms are stripped, disassembled and dropped or hoisted down onto a barge in the water below the bridge, or onto the ground in the case of bridge sections overlying the ground. These forms must thereafter be reassembled when used at a subsequent bridge section. If the height of the bridge above the water or ground is not too great, scissors jacks may be disposed on the barge or ground so that the forms may be stripped without being disassembled.

The only known apparatus in the prior art which attempted to provide an aid to the stripping of the bridge forms was a structure proposed some 25 to 30 years ago known as the "Triad Stripping Buggy" which spanned the width of the bridge but was only some 8 to 10 feet in width. In that apparatus a support structure was positioned on the concrete roadbed and supported framing above the roadbed, the framing having spaced vertically depending members at the transverse ends thereof and these members carried decking on which workmen could stand for accessing and stripping the forms. The supporting structure was pushed or pulled by a truck or tractor or the like along the roadbed and when it reached the vicinity of the pier, each half of the decking could be rolled outwardly and be rotated 90° to be free of the pier cap to permit the structure to be moved to the next section. Since a motorized vehicle was required for moving thestructure longitudinally, the vehicle was required to ride along a finished portion of the roadbed, generally before it was fully cured if excessive delays were not to be encountered, or if the bridge was of a relatively short span, a cable on the vehicle could be used to pull the structure from the unfinished end. Additionally, this arrangement could not be used where the distance between the piers was small relative to the width of the bridge lest the decking when rotated would contact the adjacent pier cap or be rolled outwardly to a point where the bending forces due to the cantilever effect were excessive. Moreover, the apparatus could not strip forms which run longitudinally because of its small width, but could be used as a work platform for workmen to loosen the form as the deck was moved longitudinally and the forms still had to be dropped. Accordingly, this apparatus did not find wide acceptance and its use appears to have been abandoned.

SUMMARY OF THE INVENTION

Consequently, it is a primary object of the present invention to provide apparatus for stripping concrete forms from a bridge structure which is self-propelled along the roadbed, the apparatus carrying a stripping buggy platform extending a substantial distance between piers and has means for transversely opening to move the work platform supports outwardly to clear the pier and pier cap.

It is another object of the present invention to provide apparatus for stripping concrete forms from bridge structures which is self propelled along the roadbed, the apparatus carrying at least one stripping buggy mounted on longitudinally spaced transversely exending tracks, the stripping buggy carrying form removal means for stripping and lowering the forms onto the buggy for transfer to the transverse ends of the apparatus, the apparatus additionally having self-contained driven means for transversely opening the tracks to clear the bridge pier caps.

It is a further object of the present invention to provide apparatus for stripping concrete forms from the roadbed of a bridge under construction which is self propelled along the roadbed, the apparatus having an upper supporting structure including telescoping members, one of the members being carried by a carriage propelled longitudinaly along the roadbed and a second of the telescoping members carrying downwardly depending framework extending beneath the roadbed and supporting longitudinally spaced apart transversely extending tracks on which a stripping buggy is mounted and driven transversely, the second of the telescoping members being driven relative to the first of the members transversely to move the stripping buggy tracks outwardly to clear the bridge pier caps.

Accordingly, the present invention provides apparatus for stripping concrete forms from the undersurface of the concrete roadbed of a bridge under construction, the apparatus having a carriage positioned on and propelled longitudinally along the upper surface of the roadbed, the carriage carrying upper supporting structure on the top thereof. The upper supporting structure includes longitudinally spaced apart transversely extending beams secured to the carriage, the beams each carrying a pair of extendable support members transversely moveable toward and away from the respective transverse ends of the beams. The support members respectively carry downwardly depending framework which extends beneath the roadbed and is secured to a work platform support section. The work platform support sections corresponding to each beam interlock to form a work platform support and may separate and provide a clearance about the piers and pier caps of the bridge. Each section of the work platform support has longitudinally spaced transversely extending rails on which at least one work platform or stripping buggy is driven transversely. The stripping buggy extend the entire length of the apparatus and carries jack means which may be raised to receive the form and thereafter lowered and driven to the ends of the work platform support for removal and transfer to a subsequent station of the bridge for use in pouring the concrete roadbed at that location.

In the preferred form of the invention, rack and pinion means drive the support members relative to the beams, the rack preferably being on the beams and the pinions being mounted on the support members. The support members carry wheels which ride on tracks formed by flanges on the beams. The stripping buggy also includes wheels which ride on the rails carried by the work platform support. Hydraulic or electric motor means may power the carriage, the rack and pinion drive and the stripping buggy so that the apparatus is independent of any external source of power and may be progressively used for stripping the forms from the entire bridge section-by-section in seriatim.

BRIEF DESCRIPTION OF THE DRAWINGS

The particular features and advantages of the invention as well as other objects will become apparent from the following description taken in connection with the accompanying drawings, in which:

FIG. 3 is a view similar to FIG. 2, but illustrating the stripping apparatus in the open or outward position of the work platform support for clearing a pier cap and supporting piers;

FIG. 4 is a fragmentary elevational view of one end of the apparatus; and

FIG. 5 is a perspective view of the stripping buggy portion of the apparatus, with the lifting jack removed for clarity.

DESCRIPTION OF THE PREFERRED EMBODIMENT

Figure 1:
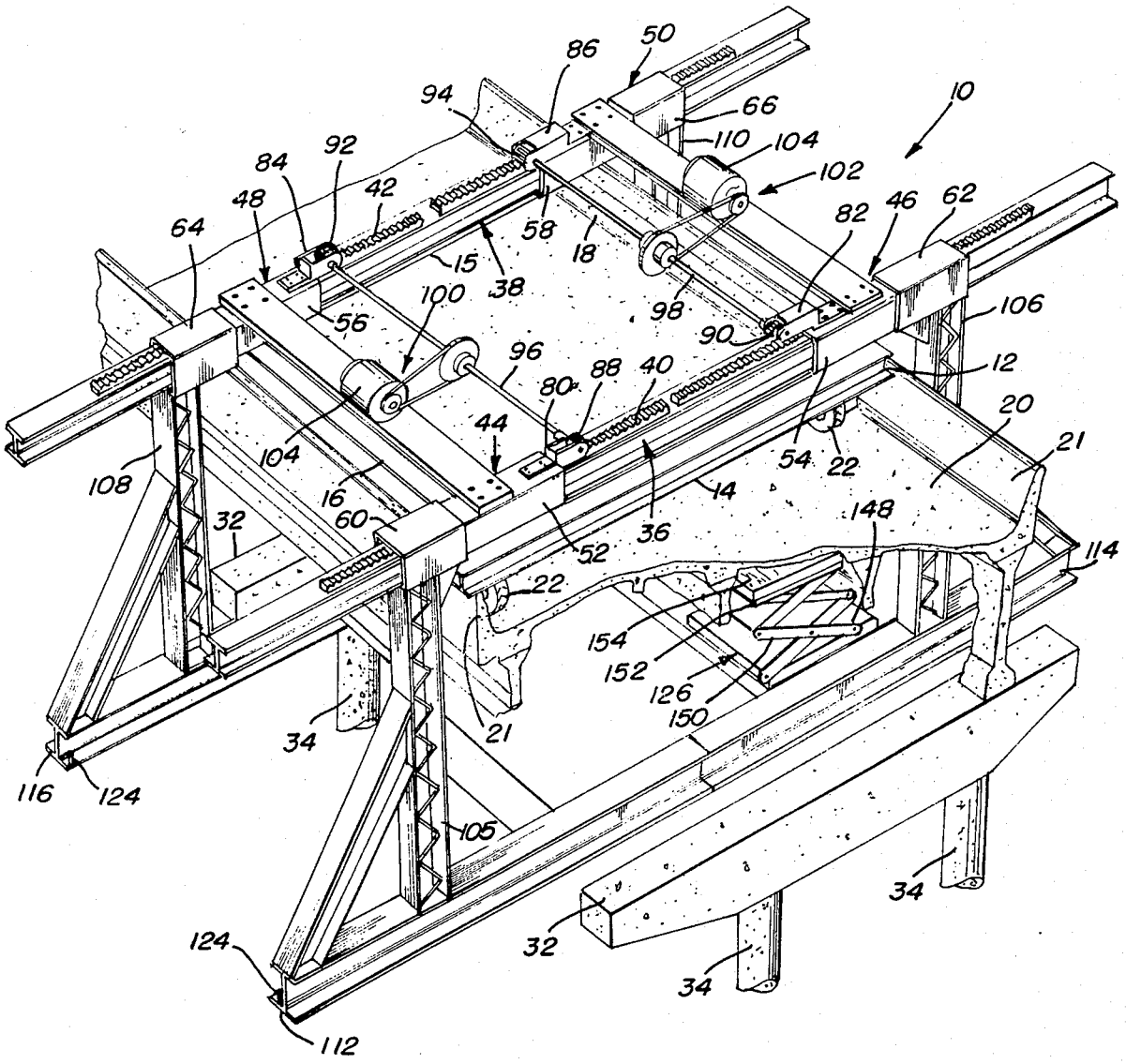
FIG. 1 is a perspective view partly broken away illustrating a portion of a bridge having a roadbed on which is carried form stripping apparatus constructed in accordance with the principles of the present invention.
Figure 2:
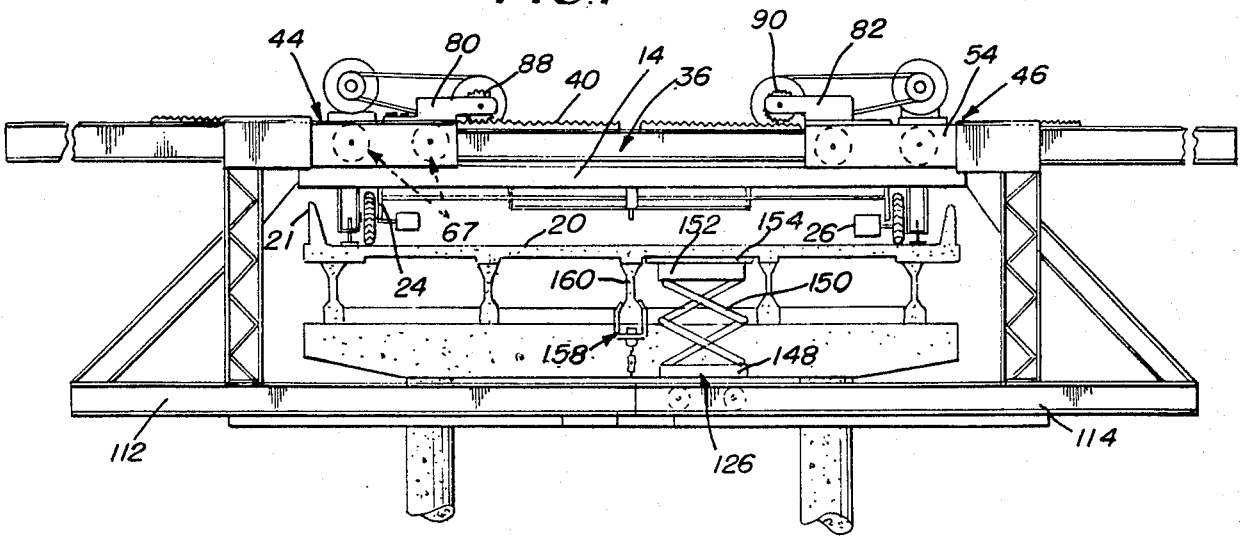
FIG. 2 is a transverse vertical cross sectional view through a bridge illustrating the stripping apparatus of the present invention in the stripping position with the work platform support disposed beneath the roadbed.

Referring to the drawings, stripping apparatus 10 constructed in accordance with the present invention comprises a support carriage 12 having a substantially rectangular frame including a pair of laterally extending front and rear beams 14, 15 connected together by a pair of longitudinally extending beams 16, 18 spaced slightly from the respective extremity of the beams 14, 15. The support carriage beams, which are preferably structural steel I-beams, may be secured together by conventional means such as welds, bolts or the like, and, although not illustrated, the frame may have diagonal cross members or wire cable bracing for providing additional rigidity and strength. The width of the lateral beams 14, 15 may be slightly shorter than the roadbed 20 between the curbs 21 thereof or as best illustrated in FIGS. 2 and 3 may extend beyond the curbs 21 and the longitudinally extending beams 16, 18 are spaced inwardly from the extremities of the beams 14, 15.

The underside of the beams 14, 15 carry a wheel 22 adjacent each extremity, the wheels being mounted for rotation within a housing 24 journalled for swivelling on the underside of the respective beams 14, 15. A hydraulic motor 26 or the like may supply power for rotatably driving the wheels in the longitudinal direction of the roadbed when the wheels 22 are positioned as illustrated in the drawings for driving the carriage longitudinally along the roadbed. Mounted adjacent each wheel 22 is a jack housing 28 within which a respective threaded jack 30 is carried, the jacks 30 being raised above the roadbed when the wheels are driven and may be lowered onto the roadbed after the carriage has been driven to each desired location at which time the wheel housings 24 are rotated or swiveled 90°. The longitudinal beams 16, 18 may be of any convenient length so that the carriage need not be driven frequently, and preferably is approximately one-half the spacing between adjacent longitudinally spaced bents or pier caps 32 of the bridge, the pier caps 32 being supported on piers or columns 34. As an example of the dimensions of the carriage beams for a particular bridge, the longitudinally extending beams 16, 18 are approximately 38 feet long which is approximately half of the 75 foot span between adjacent pier caps of the bridge.

Supported on the upper surface of each beam 14, 15 is a laterally elongated carrier beam 36, 38 respectively, each in the form of a structural I-beam, on the upper surface of which are respective gear racks 40, 42. The beams 36 and 38 are longer than the beams 14 and 15, extending substantially beyond the lateral ends of the pier caps 32. For example, in conjunction with a bridge having a pier cap approximately 52 feet in width, the beams 36, 38 are approximately 80 feet in length. The teeth of each of the gear racks 40, 42 extend from proximate one end of each beam 36, 38 to proximate the other end, albeit a small central portion of the beams may have the teeth omitted since, as will hereinafter be understood, they are unnecessary at that location.

Disposed about a portion of each beam 36, 38 is a spaced apart pair of rectangular housings 44, 46 and 48, 50 respectively. Each housing 44, 46, 48, 50 is substantially identical and comprises a respective first portion 52, 54, 56, 58 in the form of a channel member having an inverted substantially U-shaped cross sectional configuration and a respective second portion 60, 62, 64, 66 comprising a tube having a substantially rectangular box cross sectional configuration, the first portion being telescopically received within and welded to the second portion. The length of each first portion 52, 54, 46, 58 is such that its outward end is slightly outbound of the respectively end of the respective beams 14, 15 when the apparatus is in the operative position illustrated in FIG. 2 so that the lower walls of the respective second portions 60, 62, 64, 66 do not contact the respective beams 14, 15 when the apparatus is in the operative position illustrated in FIG. 2.

Carried within the interior of each channel member 52, 54, 56, 58, are two pairs of wheel means or roller means generally indicated at 67, each pair, as best illustrated in FIG. 4 with regard to channel member 54, includes first and second wheels 68, 70 rotatably journalled on a respective shaft 72, 74 fastened to the interior of the respective downward depending leg of the channel at opposite dispositions therein. Each wheel 68, 70 is disposed on the lower flange 76 of the respective I-beam 36, 38 on opposite sides of the central web 78 thereof for rolling along the flange.

Fastened on the top of each channel member or first portion 52, 54, 56, 58 is a respective pinion housing 80, 82, 84, 86 within which a respective pinion 88, 90, 92, 94 is journally carried, the pinions extending beyond the inner ends of the respective channel members 52, 54, 56, 58 and disposed in meshing relationship with the respective racks 40 and 42. The pinions 88 and 92 are connected to a first common shaft 96 while the pinions 90 and 94 are connected to a second common shaft 98, the shafts 96 and 98 extending longitudinally substantially parallel to the beams 16 and 18 of the carriage 12. Power drive means generally indicated at 100 and 102 selectively rotatably drive the shafts 96 and 98 respectively, the shafts rotating in opposite directions so that the respective housings 44, 48 and 46, 50 are laterally driven in opposite directions toward and away from each other, i.e., as the housings 44 and 48 move transversely outwardly relative to the beams 36, 38, the housings 46 and 50 also move outwardly and as the housings 44 and 48 move transversely inwardly so do the housings 46 and 50, the housings being supported by the respective wheel means 67 which roll along the respective beams 36 and 38. Although in the preferred mode of the invention the power drive means 100 and 102 comprises hydraulic motors 104 directly connected to the respective shaft 96, 98, but for illustrative purposes and clarity of presentation, the motors 104 are depicted as being indirectly connected to the shafts by conventional coupling means such as pulleys and belts.

Secured to and depending downwardly from the bottom of each tube portion 60, 62, 64, 66 of the respective housing 44, 46, 48, 50 is a respective support member in the form of truss framework 105, 106, 108, 110, which extend downwardly beneath the roadbed 20 and below the pier caps 32. Fixed to the lower end of each framework 104 and 106 is a respective work support platform section in the form of I-beams 112, 114, and although it should be understood that similar work platform support section I-beams are also likewise fixed to the framework 108, 110, only that beam 116 secured to the framework 108 is illustrated in the drawings. It may be seen that when the inner transverse ends of the platform support sections 112 and 114 abut as illustrated in FIGJ. 2, they form a continuous platform support at one longitudinal end of the apparatus 10 and the other platform support sections form another continuous platform support at the opposite longitudinal end of the apparatus, each section forming substantially one-half of the overall platform support at the respective longitudinal end. Interlocking and aligning means such as a female member in the form of a recepticle 120 carried on the bottom of one of the support platform section I-beams, e.g., platform section 112 and a cooperating male member in the form of a probe or finger 122 carried on the bottom of the cooperating section, e.g., platform section 114 ensure that the sections properly abut and form a continuous platform at each end.

Accordingly, when the power drive means is actuated in a first drive direction to drive the pinions and thus the racks thereby to drive the housings 44 and 48 toward the respective housings 46 and 50, the work platform support sections may be driven into cooperating engagement to form a continuous work platform support at each longitudinal end of the apparatus while on the other hand when the direction of actuation of the power drive means is opposite to the first direction, the work platform support sections separate, the amount of separation being such that the work platform support sections clear the transverse ends of the pier caps 32 as illustrated in FIG. 3. The transverse separation of the work platform support sections occur when the support carriage 12 is to be driven on the roadbed 20 after stripping of the forms at one section of the bridge is completed and stripping is to occur at an adjacent section and when a pier cap 32 and piers 34 are disposed in the path of the work platforms. Of course, when the carriage is positioned for stripping of the forms at the adjacent roadbed section, the work platform support sections are again driven back into the cooperating abutting positions to form the continuous work platform support at each longitudinal end of the stripping apparatus.

Secured to the interior lower flange of each I-beam 112, 114, 116 and the beams secured to the framework 110 is a track or rail in the form of an angle rail or beam 124 best illustrated in FIG. 4 with regard to the beam 114. As illustrated, the angle beam 124 is positioned with the free end of its legs on the flange so that its apex is disposed upwardly. When the work platform support sections are in the closed position forming a continuous work platform support, the tracks 124 of the cooperating sections form a continuous transversely extending track at each longitudinal end of the stripping apparatus. A work platform or stripping buggy 126 having a substantially rectangular configuration including end rails 128, 130 connected to longitudinally extending side rails 132, 134 and any necessary strengthening braces has at least two wheels 136 journally mounted on each end rail 128, 130. The wheels 136 have a V-groove configuration for being positioned on and receiving the apex of the tracks 124. Because of the Vee configuration of the wheels 136 and the rails 124, the wheels are trapped by and constrained for movement along the rails transversely of the apparatus while the buggy extends the entire length of the apparatus.

The stripping buggy 126 has an upper work support surface 138 on which workmen may stand. Additionally a pair of tracks 140, 142 extend from each longitudinal end to approximately the center of the buggy, the tracks being formed by right angle beams having one leg upstanding and the other leg spaced from and overlying the surface 138. Mounted on rollers 144 trapped in the tracks 140, 142 at each longitudinal end of the buggy 126 is the base 146 of a hydraulic lift table 148 on which is mounted a scissors jack 150, the top of which has support members 152 for receiving the concrete forms 154. Intermediate the pair of lift tables 148 is a hydraulic power unit 156 having the hydraulic actuators and controllers for driving the buggy 126 transversely along the tracks 124 and for controlling the lifting and lowering of the scissors jacks 150, and the longitudinal movement of the lift tables 148.

In operation, when the forms 154 used for pouring the roadbed are to be removed or stripped, the buggy 126 is positioned under the first selected form and the hyraulic tables are positioned at the desired locations. The scissors jacks 150 are elevated to receive the form which is loosened by the workmen on the buggy. The scissors jacks at both ends of the buggy receive the forms and the jacks are lowered. The buggy is then driven to the adjacent transverse end of the work platform support where the form may be received by a crane or the like and transferred for use in pouring a subsequent section of the bridge roadbed. The buggy is then driven into position for receiving a second form and the process is repeated until all the forms at the first section of the roadbed have been removed. The support carriage 12 is then driven to an adjacent section of the bridge for removal of the concrete pouring forms at that section at the same manner as for the first section. If a pier cap 32 is disposed in the path of the apparatus, the buggy 126 is driven to a transverse end of the work platform support as illustrated in FIG. 3, and the work platform support is opened as heretofore described to clear the pier cap for permitting the carriage to be located at the desired position. The work platform support is then closed and the buggy is driven to the desired location for removal of the forms in the same manner as heretofore described. A beam hanger 158 may be clamped about a central one of the precast or steel roadbed support beams such as beam 160 to ensure that the male and female members 122, 120 of the respective sections 114, 112 interlock properly and provide additional support in the central portion of the work platform support structure, the beam hanger merely being a turnbuckle controlled clamping arrangement connecting the beam 160 to the I-beams 112, 114 at each longitudinal end of the stripping apparatus.

Thus, the stripping apparatus has means for positioning the concrete forms support members 152 in the longitudinal, transverse and vertical directions for receiving the forms as desired. The apparatus may strip all the forms from the roadbed 20 in seriatim in a simple and continuous manner. The opening and closing of the work platform support permits the apparatus to be utilized throughout the entire length of the bridge so that the structure only has to be assembled once until the stripping process is completed. Consequently, the time for stripping the forms from the bridge is substantially reduced as is the cost thereof.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for stripping concrete forms from a longitudinally elongated roadbed extending transversely of a multi-section bridge under construction, said roadbed being supported by longitudinally spaced apart piers including pier caps extending a finite distance transversely, said apparatus comprising a carriage having interconnected longitudinally and transversely elongated beams, propulsion means carried on said carriage for selectively propelling said carriage longitudinally along said roadbed between sections of said bridge, a pair of transversely extending carrier beams supported by said carriage at longitudinally spaced positions, each carrier beam being longer than said finite distance and having ends extending transversely beyond a respective end of said pier caps, each carrier beam having means defining transversely extending tracks, a pair of housings carried on each carrier beam and disposed for riding along said tracks, drive means for selectively moving said housings transversely relatively to said carrier beams between first and second positions, a support frame secured to each housing transversely outboard of said roadbed and depending downwardly beneath said roadbed, a work platform support section carried by each support frame beneath said roadbed, each work platform support section comprising a transversely extending beam having an inboard and an outboard end, means defining a transversely extending rail on each work platform support section beam, the inboard ends of the work platform support section beams associated with each carrier beam normally abutting to form a continuous work platform support with a continuous rail when said housings are disposed in said first position and being separated and outboard of a respective transverse end of each pier cap when said housings have been driven to said second position, a longitudinally elongated stripping buggy mounted for movement on said rails, and means for selectively driving said buggy transversely along said rails, whereby concrete forms may be removed onto said buggy from each bridge section in seriatim and transferred to a subsequent bridge section and said apparatus may be moved longitudinally along said bridge from one section to another.

2. Apparatus as recited in claim 1, wherein said propulsion means comprises wheels journally mounted on the underside of said carriage and positionable on said roadbed, and means for rotatably driving said wheels selectively.

3. Apparatus as recited in claim 1, wherein each of said carrier beams comprises an I-beam including an upper flange a lower flange and a connecting web therebetween, each of said tracks comprising said lower flanges.

4. Apparatus as recited in claim 3, wherein each housing journally carries roller means disposed for rolling on said tracks.

5. Apparatus as recited in claim 4, wherein each housing is telescopically received about the respective carrier beam.

6. Apparatus as recited in claim 1, wherein each drive means comprises a rack formed on each carrier beam, a pinion gear journally carried by each housing and operatively meshing with said rack, and means for driving each pinion gear to move said housings relatively to said carrier beams.

7. Apparatus as recited in claim 1, wherein each work platform support beam comprises a longitudinally disposed flange, each rail comrpising an angle beam having an inverted V-shape configuration secured to said flange, and said buggy is journally supported by wheels having V-shaped grooves for receiving an rolling on said rails.

8. Apparatus as recited in claim 1, wherein the inboard ends of the work platform support section beams associated with each carrier beam includes cooperating members adapted to maintain alignment of said inboard ends when said carrier beams are in said first position.

9. Apparatus as recited in claim 1, wherein said buggy carries concrete form receiving means, said receiving means including elevating means for extending upwardly to the underside of said roadbed to receive said forms and for retracting downwardly with said forms thereon.

10. Apparatus as recited in claim 1, wherein said outboard ends of said work platform support sections are always transversely outboard of said pier caps.

11. Apparatus as recited in claim 4, wherein said drive means comprises a rack formed on said upper flange of each carrier beam, a pinion gear journally carried by each housing and operatively meshing with said rack, and means for driving each pinion gear to move said housings relatively to the respective carrier beam.

12. Apparatus as recited in claim 6, wherein each work platform support beam comprises a longitudinally disposed flange, each rail comrpising an angle beam having an inverted V-shape configuration secured to said flange, and said buggy is journally supported by wheels having V-shaped grooves for receiving an rolling on said rails.

13. Apparatus as recited in claim 11, wherein said propulsion means comprises wheels journally mounted on the underside of said carriage and positionable on said roadbed, and means for rotatably driving said wheels selectively.

14. Apparatus as recited in claim 13, wherein each work platform support beam comprises a longitudinally disposed flange, each rail comrpising an angle beam having an inverted V-shape configuration secured to said flange, and said buggy is journally supported by wheels having V-shaped grooves for receiving an rolling on said rails.

* * * * *